US009740232B2

(12) United States Patent
Wu

(10) Patent No.: US 9,740,232 B2
(45) Date of Patent: Aug. 22, 2017

(54) CURRENT MIRROR WITH TUNABLE MIRROR RATIO

(71) Applicant: Macronix International Co., Ltd., Hsinchu (TW)

(72) Inventor: Hsien Hung Wu, Hsinchu (TW)

(73) Assignee: Macronix International Co., Ltd., Hsinchu (TW)

( * ) Notice: Subject to any disclaimer, the term of this patent is extended or adjusted under 35 U.S.C. 154(b) by 88 days.

(21) Appl. No.: 14/698,935

(22) Filed: Apr. 29, 2015

(65) Prior Publication Data

US 2016/0320790 A1 Nov. 3, 2016

(51) Int. Cl.
*G05F 3/26* (2006.01)

(52) U.S. Cl.
CPC ..... *G05F 3/267* (2013.01)

(58) Field of Classification Search
CPC . G05F 3/26; G05F 3/262; G05F 3/267; G05F 3/16; G05F 3/24; G05F 3/30; G05F 3/242; G05F 3/225
USPC ..... 323/312–317
See application file for complete search history.

(56) References Cited

U.S. PATENT DOCUMENTS

| | | | | |
|---|---|---|---|---|
| 5,680,037 | A | 10/1997 | Carobolante | |
| 2008/0175062 | A1* | 7/2008 | Tran | G11C 16/26 365/185.21 |
| 2008/0297131 | A1* | 12/2008 | Peng | G05F 3/30 323/313 |
| 2011/0187344 | A1* | 8/2011 | Iacob | G05F 3/16 323/315 |
| 2012/0025801 | A1* | 2/2012 | Hirose | G05F 3/242 323/313 |
| 2012/0249187 | A1* | 10/2012 | Kumazaki | G05F 3/242 327/105 |

* cited by examiner

*Primary Examiner* — Adolf Berhane
*Assistant Examiner* — Bart Iliya
(74) *Attorney, Agent, or Firm* — Finnegan, Henderson, Farabow, Garrett & Dunner LLP

(57) ABSTRACT

A current mirror circuit includes a current source for generating a reference current, a mirror circuit having a first node for passing a first mirroring current and a second node for passing a second mirroring current, a feedback circuit coupled to the mirror circuit for equalizing voltages on the first and second nodes, and a tunable element coupled to the mirror circuit and driven by an output of the feedback circuit for providing a target output current.

19 Claims, 14 Drawing Sheets

CURRENT MIRROR WITH TUNABLE MIRROR RATIO

FIELD OF THE DISCLOSURE

The present disclosure relates to a current mirror and, more particularly, to a current mirror with tunable mirror ratio.

BACKGROUND OF THE DISCLOSURE

Current mirrors are widely used in analog integrated circuits. A current mirror generates an output current that mirrors a reference current. It is desirable to tune a mirror ratio between the output current and the reference current such that the output current has a precise value.

SUMMARY

According to an embodiment of the disclosure, a current mirror circuit includes a current source for generating a reference current, a mirror circuit having a first node for passing a first mirroring current and a second node for passing a second mirroring current, a feedback circuit coupled to the mirror circuit for equalizing voltages on the first and second nodes, and a tunable element coupled to the mirror circuit and driven by an output of the feedback circuit for providing a target output current.

According to another embodiment of the disclosure, a method for generating a target output current by a current mirror includes providing a current mirror including a current source for generating a reference current, a mirror circuit having a first node for passing a first mirroring current and a second node for passing a second mirroring current, a feedback circuit coupled to the mirror circuit for equalizing voltages on the first and second nodes, and a tunable element coupled to the mirror circuit and driven by an output of the feedback circuit for providing the target output current.

According to a further embodiment of the disclosure, a current mirror circuit includes a current source for generating a reference current, a mirror circuit having a first node for passing a first mirroring current and a second node for passing a second mirroring current, a feedback circuit coupled to the mirror circuit for equalizing voltages on the first and second nodes, and an output transistor coupled to the mirror circuit and driven by an output of the feedback circuit for providing an output current.

The accompanying drawings, which are incorporated in and constitute a part of this specification, illustrate disclosed embodiments and, together with the description, serve to explain the disclosed embodiments.

DETAILED DESCRIPTION

Reference will now be made in detail to the present embodiments, examples of which are illustrated in the accompanying drawings. Wherever possible, the same reference numbers will be used throughout the drawings to refer to the same or like parts.

Figure 1:
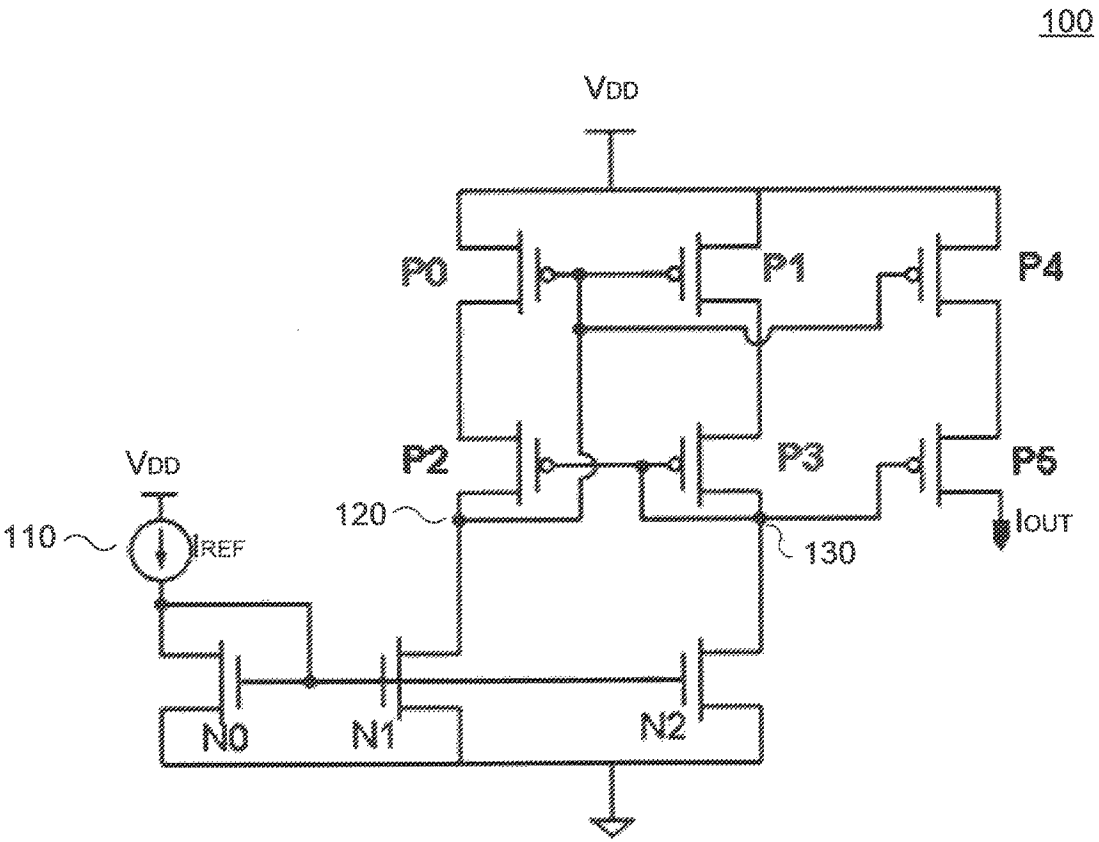
FIG. 1 schematically illustrates a circuit diagram of a conventional current mirror circuit according to an illustrated embodiment.

FIG. 1 schematically illustrates a circuit diagram of a conventional current mirror circuit 100 (hereinafter referred to as "circuit 100"), according to an illustrated embodiment. Circuit 100 includes a current source 110, N-type metal-oxide-semiconductor (NMOS) transistors N0 to N2, and P-type metal-oxide-semiconductor (PMOS) transistors P0 to P5, NMOS transistor N0 includes a drain terminal coupled to receive a reference current $I_{REF}$ generated by current source 110, a gate terminal coupled to the drain terminal, and a source terminal coupled to receive a reference voltage (e.g., ground.) NMOS transistor N1 includes a drain terminal coupled to a node 120, a gate terminal coupled to the gate terminal of NMOS transistor NO, and a source terminal coupled to ground. NMOS transistor N2 includes a drain terminal coupled to a node 130, a gate terminal coupled to the gate terminal of NMOS transistor NO, and a source terminal coupled to ground. PMOS transistor P0 includes a source terminal coupled to receive a supply voltage $V_{DD}$, a gate terminal coupled to node 120, and a drain terminal coupled to PMOS transistor P2. PMOS transistor P1 includes a source terminal coupled to receive the supply voltage $V_{DD}$, a gate terminal coupled to node 120, and a drain terminal coupled to PMOS transistor P3. PMOS transistor P2 includes a source terminal coupled to the drain terminal of PMOS transistor P0, a gate terminal coupled to node 130, and a drain terminal coupled to node 120. PMOS transistor P3 includes a source terminal coupled to the drain terminal of PMOS transistor P1, a gate terminal coupled to node 130, and a drain terminal coupled to node 130. PMOS transistor P4 includes a source terminal coupled to receive the supply voltage $V_{DD}$, a gate terminal coupled to node 120, and a drain terminal coupled to PMOS transistor P5, PMOS transistor P5 includes a source terminal coupled to the drain terminal of PMOS transistor P4, a gate terminal coupled to node 130, and a drain terminal coupled to an external circuit (not shown) for outputting an output current $I_{OUT}$.

In circuit 100, each one of NMOS transistors N0 to N2 and PMOS transistors P0 to P5 has a gate width-to-length (W/L) ratio of 10 μm/10 μm and an M factor of 1 As used herein, the "M factor" is the number of unit transistor elements connected in parallel for a transistor.

Ideally, all of NMOS transistors N0 to N2 and PMOS transistors P0 to P5 work in a saturation region. In the saturation region, a drain-source current $I_{DS}$ of a transistor is determined by, $$I_{DS} = \frac{1}{2}\mu C_{ox} M \frac{W}{L}(V_{GS} - V_{TH})^2 \quad (1)$$

where $V_{GS}$ is the gate-source voltage of the transistor, $V_{TH}$ is the threshold voltage of the transistor, μ is the charge-carrier mobility, $C_{ox}$ is the gate oxide capacitance per unit area, M is the M factor, W is the gate width, and L is the gate length.

Thus, when all of NMOS transistors N0 to N2 and PMOS transistors P0 to P5 work in a saturation region, because the gate-source voltages $V_{GS}$ of NMOS transistors N0 to N2 are the same, the drain-source currents $I_{DS}$ of NMOS transistors NO to N2 are the same. Similarly, because the gate source voltages $V_{GS}$ of PMOS transistors P0, P1, and P4 are the same, the drain-source currents $I_{DS}$ of PMOS transistors P0, P1, and P4 are the same. The drain-source currents $I_{DS}$ of PMOS transistors P2, P3, and P5 are the same as the drain-source currents $I_{DS}$ of PMOS transistors P0, P1, and P4, respectively. As a result, each one of NMOS transistors N0 to N2 and PMOS transistors P0 to P5 has a drain-source current $I_{DS}$ equal to reference current $I_{REF}$. Thus, the output current $I_{OUT}$ of circuit 100 is the same as the reference current $I_{REF}$. Accordingly, a mirror ratio of circuit 100, i.e., the ratio between the output current $I_{OUT}$ and the reference current $I_{REF}$, is 1:1.

However, when the reference current $I_{REF}$ is small, e.g., in the order of micro-amperes or even smaller, PMOS transistors P0 to P4 may leave the saturation region and enter into a linear region. In the linear region, a drain-source current $I_{DS}$ of a transistor is determined by, $$I_{DS} = \mu CoxM \frac{W}{L} V_{DS}\left(V_{GS} - V_{TH} - \frac{V_{DS}}{2}\right) \quad (2)$$

According to Equation (2), in the linear region, the drain-source current $I_{DS}$ not only relates to the gate-source voltage $V_{GS}$, but also relates to the drain-source voltage $V_{DS}$. As a result, a difference between $V_{DS_P0}$ of PMOS transistor P0 and $V_{DS_P4}$ of PMOS transistor P4 may result in a difference between $I_{DS_P0}$ of PMOS transistor P0 and $I_{DS_P4}$ of PMOS transistor P4. Such a difference may introduce errors in the mirror ratio of circuit 100.

Figure 2:
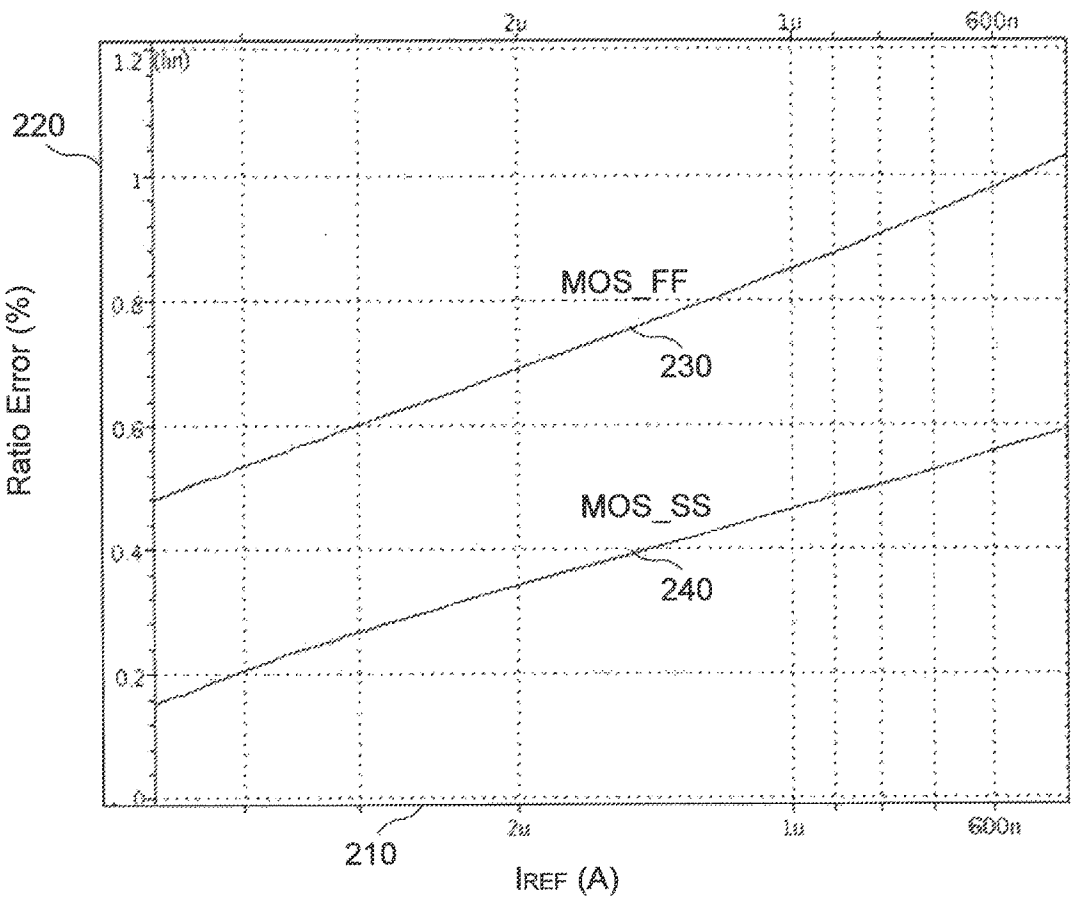
FIG. 2 is a computer simulation result of mirroring characteristics of the conventional current mirror circuit of FIG. 1.

FIG. 2 is a computer simulation result of mirroring characteristics of circuit 100. In the graph of FIG. 2, an abscissa 210 represents the reference current $I_{REF}$ (in A), and an ordinate 220 represents a ratio error (i.e., an error of the mirror ratio as compared to that of the ideal situation). Line 230 represents the ratio error versus $I_{REF}$ of circuit 100 resulting from a simulation using a fast-fast (MOS_FF) corner model. The MOS_FF corner model (hereinafter referred to as "low-$V_{TH}$ skew corner") assumes that all of the PMOS transistors and NMOS transistors in circuit 100 have been fabricated with the lowest $V_{TH}$'s. Line 240 represents the ratio error versus $I_{REF}$ of circuit 100 resulting from a simulation using a slow-slow (MOS_SS) corner model. The MOS_SS corner model assumes that all of the PMOS transistors and NMOS transistors in circuit 100 have been fabricated with the highest $V_{TH}$'s. As illustrated in FIG. 2, when reference current $I_{REF}$ is smaller than 1.24 μA, the ratio error is greater than 0.8% under the low-$V_{TH}$ skew corner model.

Figure 3:
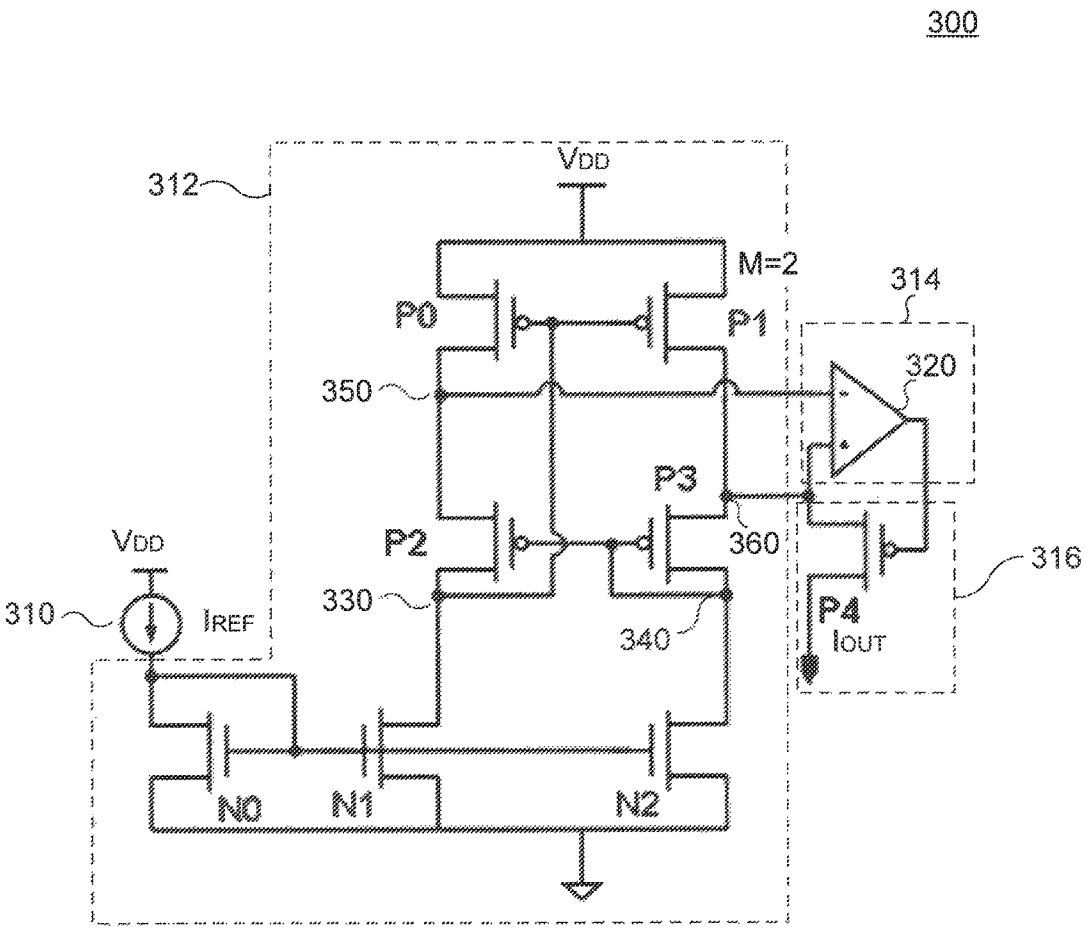
FIG. 3 schematically illustrates a circuit diagram of a current mirror circuit according to an illustrated embodiment.

FIG. 3 schematically illustrates a circuit diagram of a current mirror circuit 300 (hereinafter referred to as "circuit 300"), according to an illustrated embodiment. Circuit 300 includes a feedback path that equalizes the drain-source currents of PMOS transistors P0 and P1, and thus reduces the ratio error.

Referring to FIG. 3, circuit 300 includes a current source 310, a mirror circuit 312, a feedback circuit 314, and an output transistor 316. Mirror circuit 312 includes NMOS transistors N0 to N2, and PMOS transistors P0 to P3 which function as mirroring transistors for circuit 300. Feedback circuit 314 includes an operational amplifier 320. Output transistor 316 includes PMOS transistor P4. NMOS transistor NO includes a drain terminal coupled to receive a reference current $I_{REF}$ generated by current source 310, a gate terminal coupled to the drain terminal, and a source terminal coupled to receive a reference voltage (e.g., ground.) NMOS transistor N1 includes a drain terminal coupled to a node 330, a gate terminal coupled to the gate terminal of NMOS transistor NO, and a source terminal coupled to ground. NMOS transistor N2 includes a drain terminal coupled to a node 340, a gate terminal coupled to the gate terminal of NMOS transistor NO, and a source terminal coupled to ground. PMOS transistor P0 includes a source terminal coupled to receive the supply voltage $V_{DD}$, a gate terminal coupled to node 330, and a drain terminal coupled to a node 350. PMOS transistor P1 includes a source terminal coupled to receive the supply voltage $V_{DD}$, a gate terminal coupled to node 330, and a drain terminal coupled to node a 360. PMOS transistor P2 includes a source terminal coupled to node 350, a gate terminal coupled to node 340, and a drain terminal coupled to node 330. PMOS transistor P3 includes a source terminal coupled to node 360, a gate terminal coupled to node 340, and a drain terminal coupled to node 340. PMOS transistor P4 includes a source terminal coupled to node 360, a gate terminal coupled to operational amplifier 230, and a drain terminal coupled to an external circuit (not shown) for outputting an output current $I_{OUT}$. Operational amplifier 320 includes a non-inverting terminal (denoted as "+") coupled to node 360, an inverting terminal (denoted as "−") coupled to node 350, and an output terminal coupled to the gate terminal of PMOS transistor P4.

Each one of NMOS transistors N0 to N2 and PMOS transistors P0 to P4 has a W/L ratio of 10 μm/10 μm. The M factor $M_{P1}$ of PMOS transistor P1 is 2. The M factors of the other transistors, i.e., NMOS transistors N0 to N2 and PMOS transistors P0 and P2 to P4, are 1. In some embodiments, PMOS transistor P1 includes two unit transistor elements connected in parallel, while each one of NMOS transistors N0 to N2 and PMOS transistors P0 and P2 to P4 includes only one unit transistor element. In other embodiments, PMOS transistor P1 is fabricated with a gate width W that is twice as large as those of NMOS transistors N0 to N2 and PMOS transistors P0 and P2 to P4.

Operational amplifier 320 and PMOS transistor P4 together constitute a feedback path for circuit 300. Specifically, the non-inverting terminal of operational amplifier 320 is coupled to receive the drain-source voltage $V_{DS_P1}$ of PMOS transistor P1. The inverting terminal of operational amplifier 320 is coupled to receive the drain-source voltage $V_{DS_P0}$ of PMOS transistor P0. Operational amplifier 320 produces an output voltage that drives PMOS transistor P4. The output voltage is proportional to the difference between the drain-source voltage $V_{DS_P0}$ of PMOS transistor P0 and the drain-source voltage $V_{DS_P1}$ of PMOS transistor P1. When $V_{DS_P1}>V_{DS_P0}$, the output voltage is equal to $G\cdot(V_{DS_P1}-V_{DS_P0})$, where G is the gain of operational amplifier 320. The output voltage of operational amplifier 320 is applied to the gate terminal of PMOS transistor P4, thereby lowering the voltage at the source terminal of PMOS transistor P4. The output voltage of operational amplifier 320 will be adjusted by the difference between $V_{DS_P1}$ and $V_{DS_P0}$, until $V_{DS_P1}=V_{DS_P0}$. As a result, operational amplifier 320 equalizes $V_{DS_P1}$ and $V_{DS_P0}$.

In operation, node 350 passes a first mirroring current which is the drain-source current $I_{DS_P0}$ of PMOS transistor P0. Because the M factors of transistors N0, N1, P0, and P2 are 1, the first mirroring current is the same as the reference current $I_{REF}$. In addition, node 360 passes a second mirroring current which is the drain-source current $I_{DS_P1}$ of PMOS transistor P1. When $I_{REF}$ is small, PMOS transistors P0 and P1 work in a linear region, and $M_{P1}/M_{P0}=2$, according to Equation (2), the second mirroring current is twice as large as the first mirroring current. That is, $I_{DS_P1}=2\cdot I_{DS_P0}=2\cdot I_{REF}$. Because PMOS transistor P4 is coupled to node 360, the output current $I_{OUT}$ provided by PMOS transistor P4 is related to the second mirroring current. According to Kirchhoffs current law at node 360, the second mirroring current equals the sum of the drain-source current $I_{DS_N2}$ of NMOS transistor N2 and the drain-source current $I_{DS_P4}$ of PMOS transistor P4 (i.e., the output current $I_{OUT}$). That is, $I_{DS_P1}=I_{DS_N2}\ I_{OUT}$. Because $I_{DS_N2}=I_{REF}$, $I_{OUT}=I_{DS_P1}-I_{DS_N2}=I_{REF}$. As a result, the output current $I_{OUT}$ is the same as reference current $I_{REF}$, even when PMOS transistors P0 and P1 work in a linear region.

Figure 4:
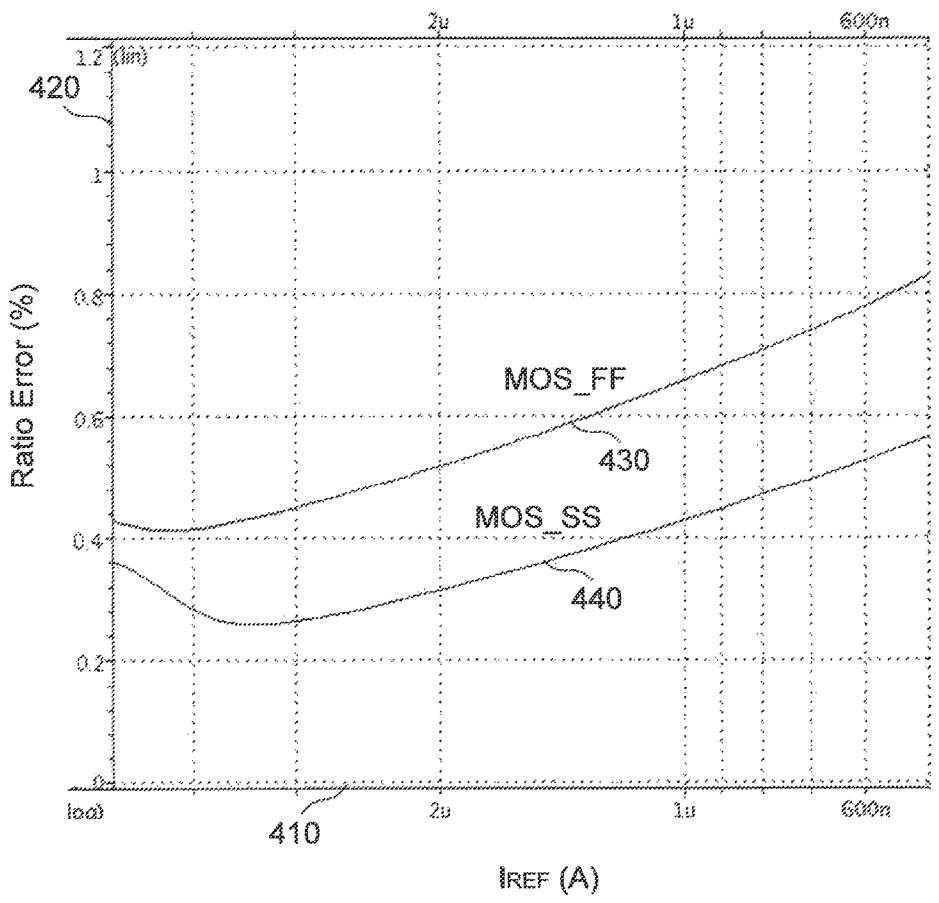
FIG. 4 is a computer simulation result of mirroring characteristics of the current mirror circuit of FIG. 3.

FIG. 4 is a computer simulation result of mirroring characteristics of circuit 300. In the graph of FIG. 4, an abscissa 410 represents reference current $I_{REF}$ (in A), and an ordinate 420 represents a ratio error. Line 430 represents the ratio error versus $I_{REF}$ of circuit 300 resulting from a simulation using the fast-fast (MOS_FF) corner model. Line 440 represents the ratio error versus $I_{REF}$ of circuit 300 resulting from a simulation using the slow-slow (MOS_SS) corner model. As illustrated in FIG. 4, only when reference current $I_{REF}$ is smaller than 550 nA, the ratio error is greater than 0.8% under the low-$V_{TH}$ skew corner model.

Figure 5:
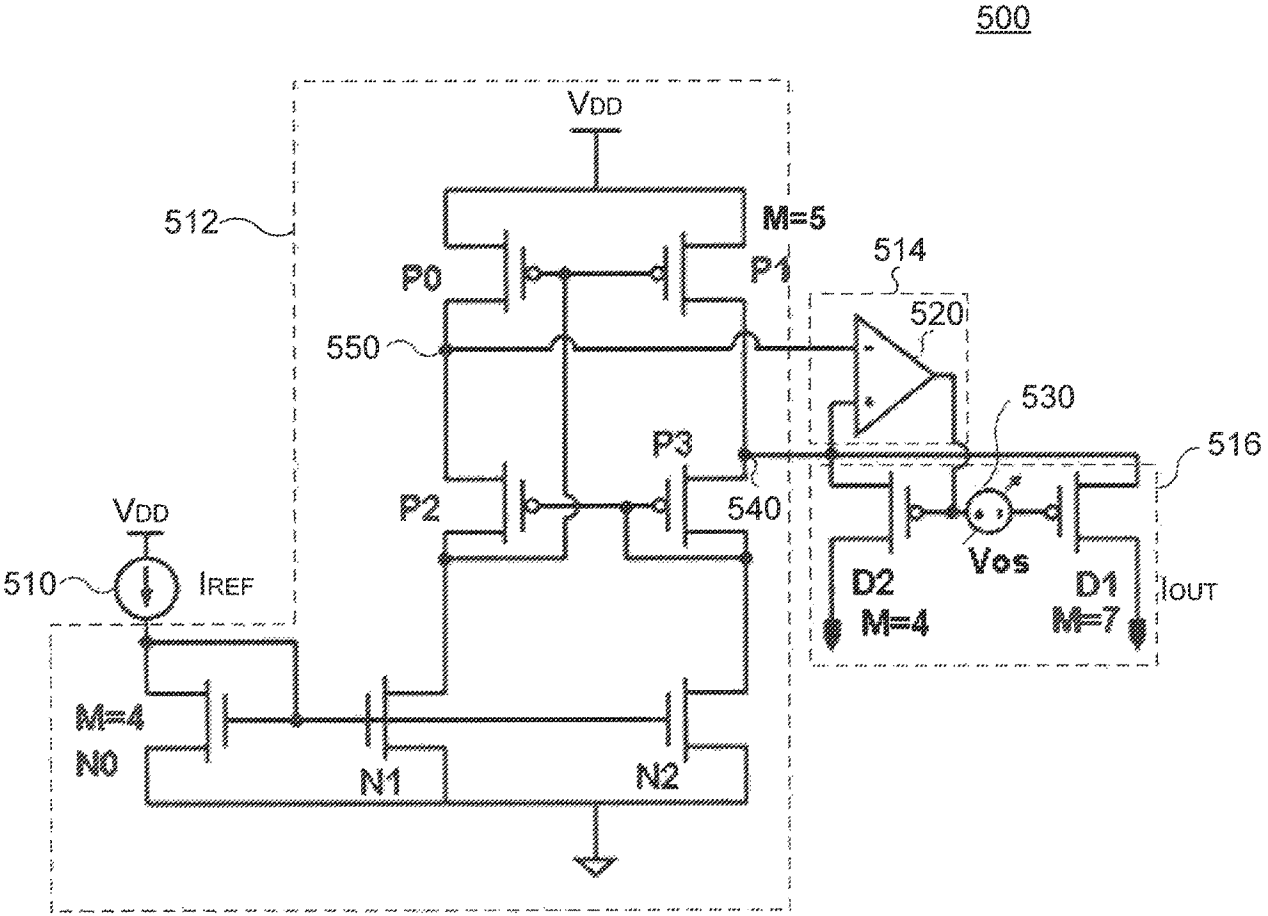
FIG. 5 schematically illustrates a circuit diagram of a current mirror circuit according to an illustrated embodiment.

FIG. 5 schematically illustrates a circuit diagram of a current mirror circuit 500 (hereinafter referred to as "circuit 500"), according to an illustrated embodiment. Circuit 500 includes a tunable element within a feedback path, such that a mirror ratio of circuit 500 is tunable to be a target value which is not solely determined by the M-factors of MOS transistors.

Referring to FIG. 5, circuit 500 includes a current source 510, a mirror circuit 512, a feedback circuit 514, and a tunable element 516. Mirror circuit 512 includes NMOS transistors N0 to N2, and PMOS transistors P0 to P3 that function as mirroring transistors for circuit 500. Feedback circuit 514 includes an operational amplifier 520. Tunable element 516 includes PMOS transistors D1, and 02, and an adjustable voltage source 530. PMOS transistors D1 and 02 function as output transistors for circuit 500. The couplings of current source 510, NMOS transistors N0 to N2, PMOS transistors P0 to P3, and operational amplifier 520 are similar to current source 310, NMOS transistors N0 to N2, PMOS transistors P0 to P3, and operational amplifier 320 in circuit 300. Thus, a detailed description of the couplings is not provided.

Comparing to circuit 300, circuit 500 includes tunable element 516 in the place of PMOS transistor P4 of circuit 300. Tunable element 516 is coupled within a feedback path of circuit 500 for providing the target output current. Specifically, operational amplifier 520 includes a non-inverting terminal (denoted as "+") coupled to a node 540 (which is the source terminal of PMOS transistor P3), an inverting terminal (denoted as "−") coupled to a node 550 (which is the drain terminal of PMOS transistor P0), and an output terminal coupled to PMOS transistor D2. PMOS transistor D1 includes a source terminal coupled to node 540, a gate terminal coupled to adjustable voltage source 530, and a drain terminal coupled to an external circuit (not shown) for outputting an output current $I_{OUT}$. PMOS transistor D2 includes a source terminal coupled to node 540, a gate terminal coupled to the output terminal of operational amplifier 520, and a drain terminal coupled to the external circuit. Both of PMOS transistors D1 and D2 are driven by the output of operational amplifier 520. Adjustable voltage source 530 includes a positive terminal (denoted as "+") coupled to the gate terminal of PMOS transistor D2, and a negative terminal (denoted as "−") coupled to the gate terminal of PMOS transistor D1.

Each one of NMOS transistors N0 to N2 and PMOS transistors P0 to P3, D1, and D2 has a W/L ratio of 10 μm/10 μm. The M factor $M_{N0}$ of NMOS transistor N0 is 4. The M factor $M_{P1}$ of PMOS transistor P1 is 5. The M factor $M_{D1}$ of PMOS transistor D1 is 7. The M factor $M_{D2}$ of PMOS transistor D2 is 4. The M factors of the other transistors, i.e., NMOS transistors N1 and N2 and PMOS transistors P0, P2, and P3, are 1.

In operation, node 550 passes a first mirroring current which is the drain-source current $I_{DS_P0}$ of PMOS transistor P0, and $I_{DS_P0}=I_{REF}/4$. Node 540 passes a second mirroring current which is the drain-source current $I_{DS_P1}$ of PMOS transistor P1, and $I_{DS_P1}=5I_{REF}/4$. According to Kirchhoff's current law at node 540, the second mirroring current equals the sum of the drain-source current $I_{DS_N2}$ of NMOS transistor N2, the drain-source current $I_{DS_D1}$ of PMOS transistor D1 (i.e., output current $I_{OUT}$), and the drain-source current $I_{DS_D2}$ of PMOS transistor D2. That is, $I_{DS_P1}=I_{DS_N2}+I_{DS_D1}+I_{DS_D2}$. Because $I_{DS_N2}=I_{REF}/4$, $I_{DS_D1}+I_{DS_D2}=I_{DS_P1}-I_{DS_N2}=5\cdot I_{REF}/4-I_{REF}/4=I_{REF}$.

Adjustable voltage source 530 generates an offset voltage $V_{OS}$, which is applied between the gate-source voltage $V_{GS_D2}$ of PMOS transistor D2 and the gate-source voltage $V_{GS_P1}$ of PMOS transistor D1. The offset voltage $V_{OS}$ can be adjusted to obtain a target output current $I_{target}$. The relationship between the offset voltage $V_{OS}$ and the target output current $I_{target}$ can be derived as follows.

First, it is assumed that both PMOS transistors D1 and D2 work in a saturation region. Thus, according to Equation (1), for each one of PMOS transistors D1 and D2, $$V_{GS} = V_{TH} + \sqrt{2I_{DS}/\beta} \quad (3)$$

where $$\beta = \mu C_{ox} M \frac{W}{L}.$$

The offset voltage $V_{OS}$ creates a difference between the gate-source voltage $V_{GS_D1}$ of PMOS transistor D1 and the gate-source voltage $V_{GS_P2}$ of PMOS transistor D2. Thus, the offset voltage $V_{DS}$ can be represented by, $$V_{OS} = V_{GS_D1} - V_{GS_D2} = \sqrt{2/(C_{ox}W/L)} \cdot \mu^{-1/2} \cdot \left(\sqrt{I_{DS_D1}/M_{D1}} - \sqrt{I_{DS_D2}/M_{D2}}\right) \quad (4)$$

In order for the output current (i.e., the drain-source current $I_{DS_D1}$ of PMOS transistor D1) to be equal to $I_{target}$, $I_{DS_D1}$ should be equal to $I_{target}$. Because $I_{DS_D2}=I_{REF}-I_{DS_D1}$, $I_{DS_D2}=I_{REF}-I_{target}$. Accordingly, Equation (4) can be transformed to, $$V_{OS} = \sqrt{2/(C_{ox}W/L)} \cdot \mu^{-1/2} \cdot \left(\sqrt{I_{target}/M_{D1}} - \sqrt{(I_{REF} - I_{target})/M_{D2}}\right) \quad (5)$$

Therefore, by adjusting $V_{OS}$ according to Equation (5), circuit 500 can generate a target output current $I_{target}$. For example, when $I_{REF}$=12.6 μA, $V_{OS}$ can be adjusted such that the output current $I_{OUT}=I_{target}$=10 μA with the arrangement of tunable element 516 described above. Thus, a desired mirror ratio can be achieved by tuning the offset voltage $V_{OS}$.

In circuit 500, the M factors of PMOS transistors D1 and D2 are not limited to 7 and 4, respectively, and can be any integer value depending on an application of circuit 500. When the M factors of PMOS transistors D1 and D2 change, the offset voltage $V_{OS}$ needs to be adjusted accordingly.

In circuit 500, the polarity of adjustable voltage source 530 (i.e., the coupling of the positive and negative terminals of adjustable voltage source 530 in circuit 500) is determined based on the reference current $I_{REF}$, the target output current $I_{target}$, and the M factors of PMOS transistors D1 and D2. If $$I_{target} > I_{REF} \cdot \frac{M_{D1}}{M_{D1} + M_{D2}},$$

then the positive terminal of adjustable voltage source 530 is coupled to the gate terminal of PMOS transistor D2, and the negative terminal of adjustable voltage source 530 is coupled to the gate terminal of PMOS transistor D1, as illustrated in FIG. 5. On the other hand, if, $$I_{target} < I_{REF} \cdot \frac{M_{D1}}{M_{D1} + M_{D2}},$$

then the polarity of adjustable voltage source 530 is reversed. That is, the positive terminal of adjustable voltage source 530 is coupled to the gate terminal of PMOS transistor D1, and the negative terminal of adjustable voltage source 530 is coupled to the gate terminal of PMOS transistor D2. If $$I_{target} = I_{REF} \cdot \frac{M_{D1}}{M_{D1} + M_{D2}},$$

then the output current $I_{DS_D1}$ is the target output current $I_{target}$. In this case, the offset voltage $V_{OS}$ to be generated by the adjustable voltage source 530 is zero. As a result, the polarity of adjustable voltage source 530 can be configured in either way described above.

Figure 6A:
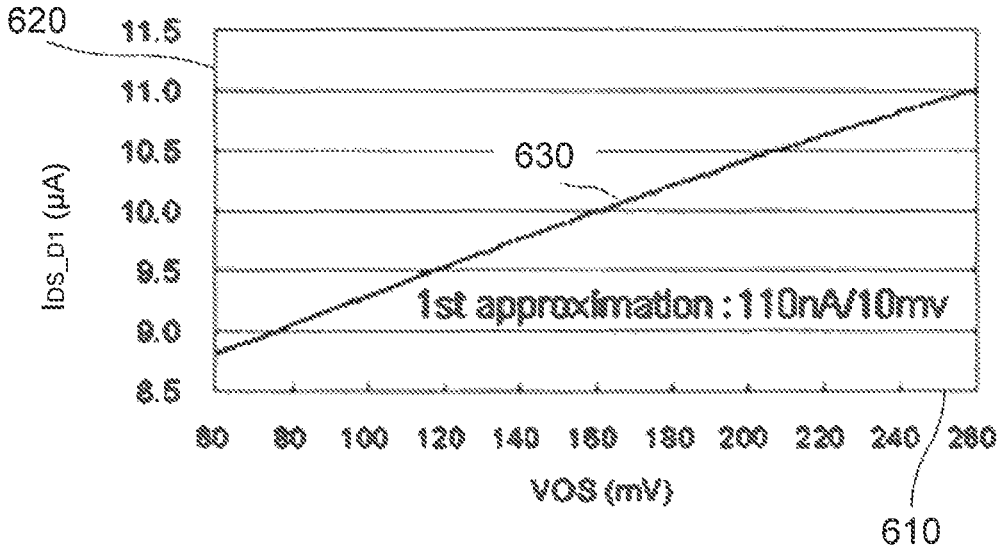
FIG. 6A is a graph illustrating a relationship between an offset voltage and a drain-source current of a PMOS transistor in the current mirror circuit of FIG. 5, according to an embodiment.
Figure 6B:
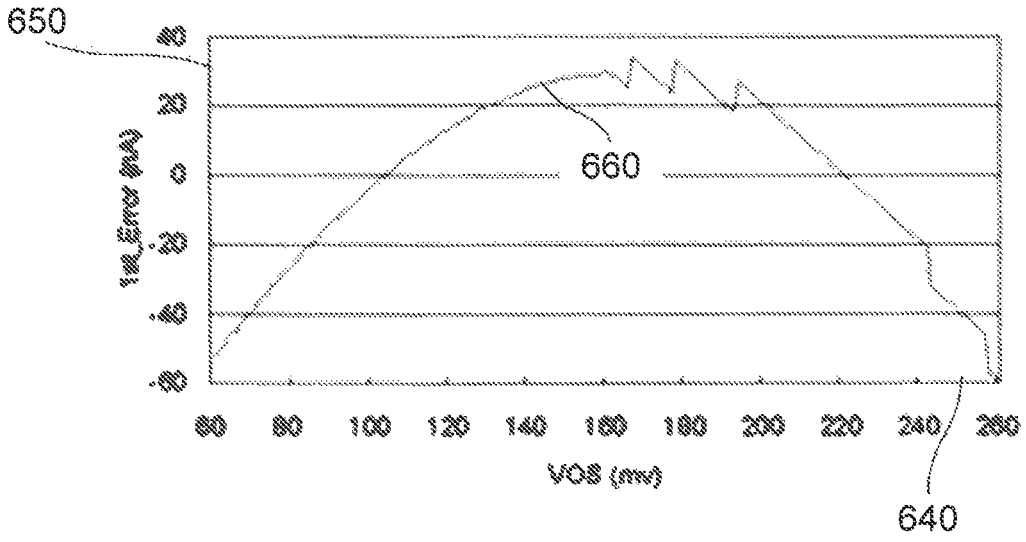
FIG. 6B is a graph illustrating an error in the relationship illustrated in FIG. 6A.

FIG. 6A is a graph illustrating a relationship between the offset voltage $V_{OS}$ and the drain-source current $I_{DS_D1}$ of PMOS transistor D1, according to an embodiment. In the graph of FIG. 6A, an abscissa 610 represents the offset voltage $V_{OS}$ (in mV), and an ordinate 620 represents the drain-source current $I_{DS_D1}$ (in ρA) of PMOS transistor D1. Line 630 represents the relationship between the offset voltage Vas and the drain-source current $I_{DS_D1}$ of PMOS transistor D1, the relationship being obtained by a first-order linear approximation. FIG. 6B is a graph illustrating an error of the first-order linear approximation of the relationship between offset voltage $V_{OS}$ and the drain-source current $I_{DS_D1}$ of PMOS transistor D1, according to an embodiment. In the graph of FIG. 6B, an abscissa 640 represents the offset voltage $V_{OS}$ (in mV), and an ordinate 650 represents the error of the drain-source current $I_{DS_D1}$ (in nA) obtained by the first-order linear approximation. Line 660 represents the relationship between the offset voltage $V_{OS}$ and the error of the drain-source current $I_{DS_D1}$ of PMOS transistor D1 obtained by the first-order linear approximation.

Figure 7:
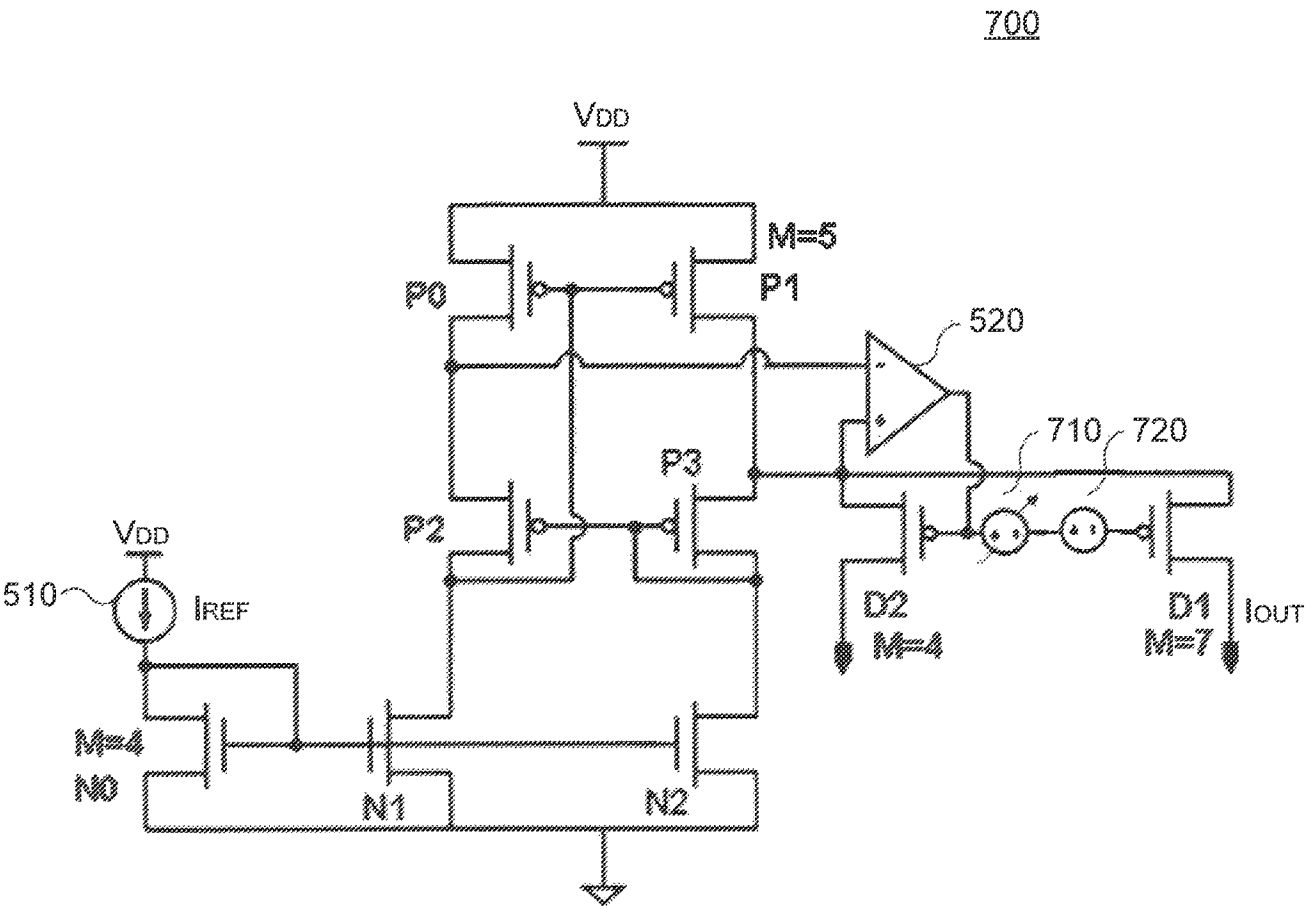
FIG. 7 schematically illustrates a circuit diagram of a current mirror circuit according to an illustrated embodiment.

FIG. 7 schematically illustrates a circuit diagram of a current mirror circuit 700 (hereinafter referred to as "circuit 700"), according to an illustrated embodiment. Circuit 700 includes a temperature dependent voltage source, such that an output current $I_{OUT}$ of circuit 700 is temperature independent. That is, the output current $I_{OUT}$ does not vary with an operation temperature of circuit 700, i.e., the temperature of circuit 700 when circuit 700 is operating.

Referring to FIG. 7, circuit 700 includes current source 510, NMOS transistors N0 to N2, PMOS transistors P0 to P3, D1, and D2, an operational amplifier 520, that are similar to the components of circuit 500. Different from circuit 500, circuit 700 includes a temperature independent voltage source 710 and a temperature dependent voltage source 720 between the gates of PMOS transistors D1 and D2. Temperature independent voltage source 710 generates a room temperature offset voltage, which is adjustable to obtain a target output current at room temperature. Temperature dependent voltage source 720 generates a temperature dependent voltage, which is used to compensate for a variation of the output current due to a temperature variation between the room temperature and the operation temperature of circuit 700.

In circuit 700, current source 510 is a temperature independent source. That is, $I_{REF}$ generated by current source 510 does not vary with the operation temperature of circuit 700. However, some device parameters of the transistors of circuit 700, such as the threshold voltage $V_{TH}$ and the charge-carrier mobility p, may vary with the operation temperature. Without the temperature dependent voltage source 720, even when the output current $I_{OUT}$ reaches a target value at room temperature, the output current $I_{OUT}$ may drift away from the target value when the operation temperature drifts away from the room temperature. In order to keep $I_{OUT}$ temperature independent, temperature dependent voltage source 720 generates the temperature dependent voltage to compensate for the variation of process parameters of the transistors due to the temperature variation. The relationship between the room temperature offset voltage, the temperature dependent voltage, and the operation temperature T can be derived as follows.

First, the charge-carrier mobility p is temperature dependent, which can be represented by, $$\mu=\mu_0\cdot(T/T_0)^{-\alpha} \tag{6}$$

where $T_0$ is the room temperature, $\mu_0$ is the charge-carrier mobility when the operation temperature is the room temperature $T_0$, $\mu$ is the charge-carrier mobility at the operation temperature T, and $\alpha$ is the mobility temperature exponent of the charge-carrier mobility $\mu$ for MOS transistors of a given technology.

The charge-carrier mobility $\mu$ can be approximated by using first-order Taylor expansion, such that, $$\mu=\mu_0\cdot(T/T_0)^{-\alpha}=\mu_0\cdot(1+\Delta T/T_0)^{-\alpha}$$

$$\mu^{-1/2}=\mu_0^{-1/2}\cdot(1+\Delta T/T_0)^{\alpha/2}\approx\mu_0^{-1/2}\cdot[1+(\alpha/2T_0)\cdot\Delta T] \tag{7}$$

where $\Delta T=T-T_0$.

Combining Equations (4) and (7) results in, $$V_{OS}=\sqrt{2/(C_{ox}W/L)}\cdot\mu_0^{-1/2}\cdot[1+(\alpha/2T_0)\cdot\Delta T]\cdot\left(\sqrt{I_{DS_D1}/M_{D1}}-\sqrt{I_{DS_D2}/M_{D2}}\right) \tag{8}$$

where $V_{OS}$ is the offset voltage generated by the combination of temperature independent voltage source 710 and temperature dependent voltage source 720.

Assume a target drain-source current of PMOS transistor D1 (i.e., the target output current of circuit 700) at room temperature is $I_{10}$, and a drain-source current of PMOS transistor D2 at room temperature is $I_{20}$. That is, at room temperature, $I_{DS_D1}=I_{10}$, and $I_{DS_D2}=I_{20}$. Let $\sqrt{I_{10}/M_{D1}}=B_1$, and $\sqrt{I_{20}/M_{D2}}=B_2$. Then, Equation (8) can be written as, $$V_{OS}=\sqrt{2/(C_{ox}W/L)}\cdot\mu_0^{-1/2}\cdot[1+(\alpha/2T_0)\cdot\Delta T]\cdot(B_1-B_2) \tag{9}$$

The offset voltage $V_{OS}$ can be represented by a room temperature offset voltage $V_{OS0}$ and a temperature coefficient TC, as $$V_{OS}=V_{OS0}\cdot(1+TC\cdot\Delta T) \tag{10}$$

where $V_{OS0}$ is the room temperature offset voltage generated by temperature independent voltage source 710, $V_{OS0}\cdot TC\cdot\Delta T$ is the temperature dependent voltage generated by temperature dependent voltage source 720, and TC is a temperature coefficient for the offset voltage $V_{OS}$.

Comparing Equations (9) and (10), the room temperature offset voltage $V_{OS0}$ and the temperature coefficient TC can be represented by, $$V_{OS0}=\sqrt{2/(C_{ox}W/L)}\cdot\mu_0^{-1/2}\cdot(B_1-B_2) \tag{11}$$

$$TC=\alpha/2T_0 \tag{12}$$

According to Equation (11), for a given reference current $I_{REF}$, the room temperature offset voltage $V_{OS0}$ is determined according to Equation (11) to obtain a given target output current $I_{10}$ at room temperature. That is, the room temperature offset voltage $V_{OS0}$ is determined based on the target output current $I_{10}$, the reference current $I_{REF}$, the gate oxide capacitance per unit area $C_{ox}$, the width-to-length ratio W/L, and the room temperature charge-carrier mobility $\mu_0$. In one embodiment consistent with the disclosure, when determining the room temperature offset voltage $V_{OS0}$, it is assumed that both of $C_{ox}$ and $\mu_0$ do not vary with device fabrication processes, i.e., $C_{ox}$ and $\mu_0$ are consistent across various process corners, such as a MOS_TT corner (in which all of the NMOS transistors and PMOS transistors have typical $V_{TH}$'s between the highest $V_{TH}$'s and the lowest $V_{TH}$'s,) a MOS_FF corner (in which all of the NMOS transistors and PMOS transistors have the lowest $V_{TH}$'s,) a MOS_SS corner (in which all of the PMOS transistors and NMOS transistors have the highest $V_{TH}$'s,) a MOS_FS corner (in which all of the NMOS transistors have the lowest $V_{TH}$'s, and all of the PMOS transistors have the highest $V_{TH}$'s,) and a MOS_SF corner (in which all of the NMOS transistors have the highest $V_{TH}$'s, and all of the PMOS transistors have the lowest $V_{TH}$'s.) Once the room temperature offset voltage $V_{OS0}$ is determined, the room temperature offset voltage $V_{OS0}$ is fixed and does not vary with temperature during the operation of circuit 700. In addition, because the temperature coefficient TC is independent of temperature variation according to Equation (12), the term $V_{OS0}\cdot TC\cdot$does not vary with temperature either. Thus, during the operation of circuit 700, the only variable in the offset voltage $V_{OS}=V_{OS0}+V_{OS0}\cdot TC\Delta T$ is the temperature difference $\Delta T$ between the operation temperature T and the room temperature $T_0$. Therefore, the offset voltage $V_{OS}$ that varies with the temperature difference $\Delta T$ can be used to compensate for the variation of process parameters of the transistors due to the temperature variation.

Figure 8:
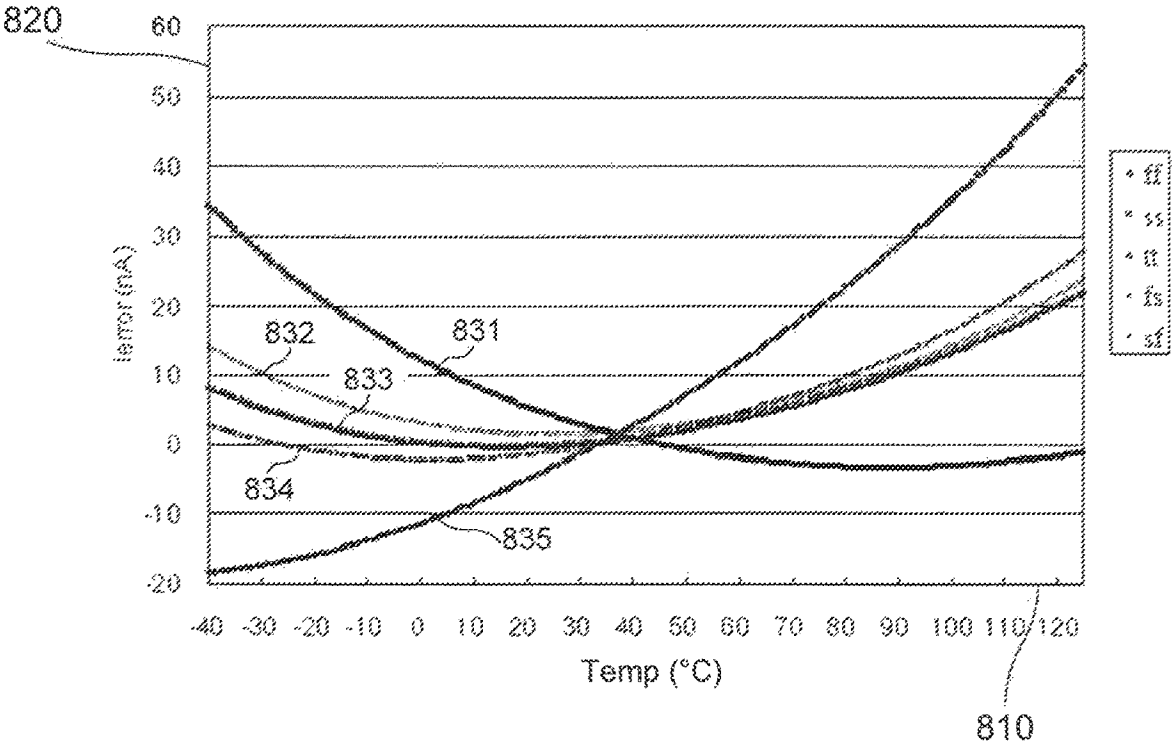
FIG. 8 is a computer simulation result of temperature compensation characteristics of the current mirror circuit of FIG. 7.

FIG. 8 is a computer simulation result of temperature compensation characteristics of circuit 700. In the graph of FIG. 8, an abscissa 810 represents the operation temperature T (in degrees C.), and an ordinate 820 represents an output current error $I_{error}$ (in nA) between the actual output current $I_{OUT}$ and the target output current $I_{10}$. Curve 831 represents the output current error $I_{error}$ versus operation temperature (hereinafter referred to as "temperature compensation error") resulting from a simulation using the slow-slow (MOS_SS) corner model, which assumes that all of the PMOS transistors and NMOS transistors in circuit 700 have the highest $V_{TH}$'s. Curve 832 represents the temperature compensation error resulting from a simulation using a fast-slow (MOS_FS) corner model, which assumes that all of the NMOS transistors have the lowest $V_{TH}$'s, and all of the PMOS transistors have the highest $V_{TH}$'S. Curve 833 represents the temperature compensation error resulting from a simulation using a typical-typical (MOS_TT) corner model, which assumes that all of the NMOS transistors and PMOS transistors have typical $V_{TH}$'s between the highest $V_{TH}$'s and the lowest $V_{TH}$'s. Curve 834 represents the temperature compensation error resulting from a simulation using a slow-fast (MOS_SF) corner model, which assumes that all of the NMOS transistors have the highest $V_{TH}$'s, and all of the PMOS transistors have the lowest $V_{TH}$'s. Curve 835 represents the temperature compensation error resulting from a simulation using the fast-fast (MOS_FF) corner model, which assumes that all of the NMOS transistors and PMOS transistors have the lowest $V_{TH}$'s.

During the simulations to produce the results illustrated in FIG. 8, $I_{REF}$ is set to be 12.6 μA and $V_{OS0}$ is determined according to Equation (11) to meet $I_{out}=I_{10}=10$ uA at $T_0$, which is the middle of a temperature simulation range for each process corner. In addition, the temperature dependent voltage $V_{OS0}\cdot TC\cdot\Delta T$ is assumed to not be adjustable. When determining $V_{OS0}$ for the MOS_FF corner, the MOS_SS corner, the MOS_FS corner, and the MOS_SF corner, parameters including Cox and μ in the typical-typical (MOS_TT) corner model are utilized as the Cox and μ for the these four corners. However, such determined temperature dependent voltage $V_{OS0}$·TC·ΔT does not track process variations of the PMOS and NMOS transistors. That is, device parameters such as Cox and μ vary with device fabrication processes, and are different in different process corners, such as the MOS_FF corner, the MOS_SS corner, the MOS_FS corner, and the MOS_SF corner. The differences of Cox and μ in these process corners may result in variations of the temperature compensation error across these process corners. As a result, as illustrated in FIG. 8, curves 831 to 835 each representing the temperature compensation error at a respective process corner, are different. For example, when the operation temperature is 120° C., the temperature compensation error resulting from the MOS_FF corner model is nearly doubled compared to the temperature compensation errors resulting from the other corner models. As another example, when the operation temperature is −40° C., the temperature compensation error resulting from the MOS_SS corner model is the highest compared to the temperature compensation error resulting from the other corner models.

During the simulations to produce the results illustrated in FIG. 8, both of Cox and μ vary across process corners. However the present disclosure is not limited thereto. If only Cox varies across process corners but p does not, the temperature dependent voltage $V_{OS0}$·TC·ΔT determined based on the MOS_TT corner model still cannot track process variations. Thus, the temperature compensation errors across these process corners are different.

Figure 9:
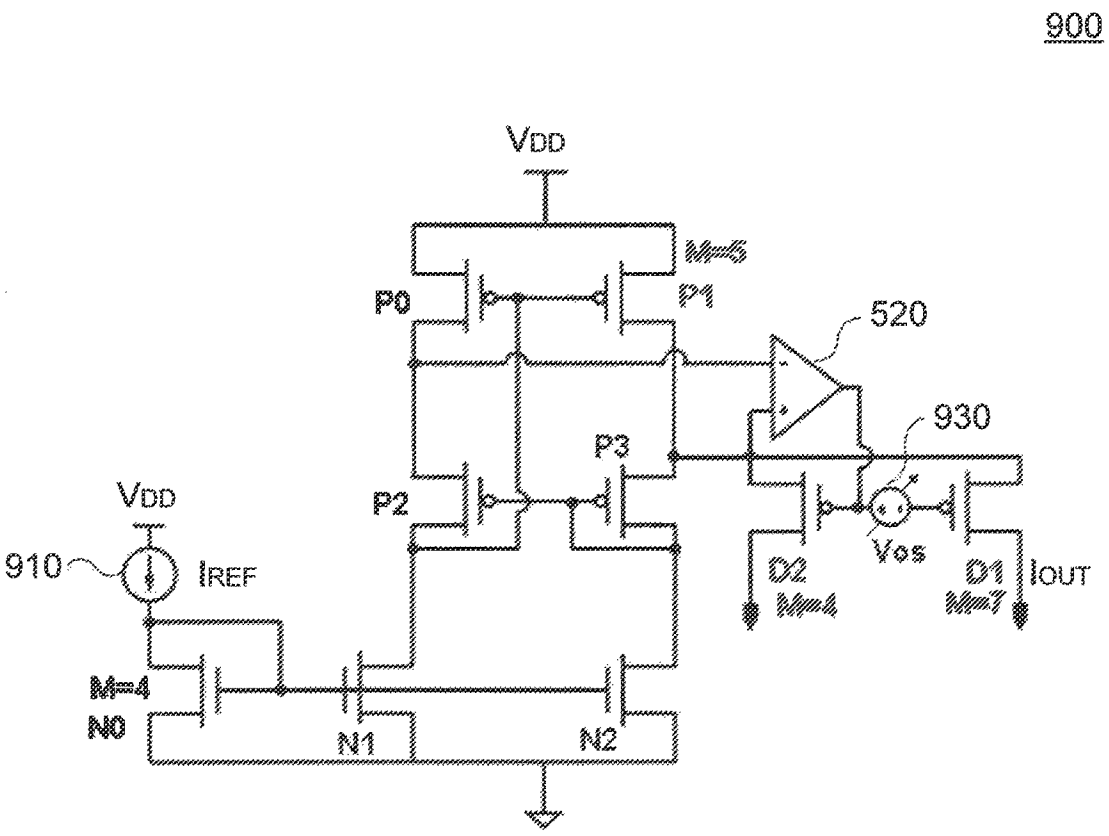
FIG. 9 schematically illustrates a circuit diagram of a current mirror circuit according to an illustrated embodiment.

FIG. 9 schematically illustrates a circuit diagram of a current mirror circuit 900 (hereinafter referred to as "circuit 900"), according to an illustrated embodiment. Circuit 900 includes a temperature dependent current source for compensating for the temperature variation.

Referring to FIG. 9, circuit 900 includes a current source 910, NMOS transistors N0 to N2, PMOS transistors P0 to P3, D1, and D2, operational amplifier 520, and a voltage source 930. The couplings of current source 910, NMOS transistors NO to N2, PMOS transistors P0 to P3, D1, and D2, operational amplifier 520, and voltage source 930 of circuit 900 are similar to those of the similar components of circuit 500. Each one of NMOS transistors N0 to N2 and PMOS transistors P0 to P3, D1, and D2 has a W/L ratio of 10 μm/10 μm. The M factor $M_{N0}$ of NMOS transistor N0 is 4. The M factor $M_{P1}$ of PMOS transistor P1 is 5. The M factor $M_{D1}$ of PMOS transistor D1 is 7. The M factor $M_{D2}$ of PMOS transistor D2 is 4. The M factors of the other transistors, i.e., NMOS transistors N1, N2, and PMOS transistors P0 P2, and P3, are 1.

In circuit 900, current source 910 is a temperature dependent current source, which generates a reference current $I_{REF}$ that changes as the operation temperature T changes. Voltage source 930 is a temperature independent voltage source, which generates an offset voltage $V_{OS}$ that does not change as the operation temperature T changes. In order to keep $I_{OUT}$ temperature independent, current source 910 is configured to provide the reference current $I_{REF}$ that is adjustable based on the operation temperature T to compensate for the variation of process parameters of the transistors due to the temperature variation. The relationship between the reference current $I_{REF}$ and the operation temperature T can be derived as follows.

First, assume that the temperature dependent reference current $I_{REF}$ can be represented by, $$I_{REF}=I_0[1+\Delta T\cdot TC] \tag{13}$$

where $I_0$ is the reference current at room temperature $T_0$, $I_0$·ΔT·TC is a temperature dependent part of the reference current $I_{REF}$, $\Delta T=T-T_0$, and TC is a temperature coefficient for $I_{REF}$.

At room temperature, $I_{DS_D1}=I_{10}$, $I_{DS_D2}=I_{20}$, and $I_{REF}=I_{DS_D1}+I_{DS_D2}=I_{10}+I_{20}$. Thus, $I_{DS_D2}$ can be represented by, $$\begin{aligned} I_{DS_D2} &= I_{REF} - I_{10} \\ &= I_0[1+\Delta T\cdot TC] - I_{10} \\ &= I_0 - I_{10} + I_0\Delta T\cdot TC \\ &= I_{20} + I_0\Delta T\cdot TC \end{aligned} \tag{14}$$

Combining Equations (4) and (14), the offset voltage $V_{OS}$ can be represented by, $$\begin{aligned} V_{OS} &= V_{GS_D1} - V_{GS_D2} \\ &= \sqrt{2/(C_{ox}W/L)}\cdot\mu^{-1/2}\cdot\left[\sqrt{I_{DS_D1}/M_{D1}} - \sqrt{I_{DS_D2}/M_{D2}}\right] \\ &= \sqrt{2/(C_{ox}W/L)}\cdot\mu^{-1/2}\cdot\left[\sqrt{I_{10}/M_{D1}} - \sqrt{(I_{REF}-I_{10})/M_{D2}}\right] \\ &= \sqrt{2/(C_{ox}W/L)}\cdot\mu^{-1/2}\cdot \\ &\quad\left[\sqrt{I_{10}/M_{D1}} - \sqrt{(I_{20}+I_0\cdot TC\cdot\Delta T)/M_{D2}}\right] \\ &= \sqrt{2/(C_{ox}W/L)}\cdot\mu^{-1/2}\cdot \\ &\quad\left[\sqrt{I_{10}/M_{D1}} - \sqrt{I_{20}/M_{D2}}\sqrt{1+(I_0\cdot TC\cdot\Delta T)/I_{20}}\right] \\ &\cong \sqrt{2/(C_{ox}W/L)}\cdot\mu^{-1/2}\cdot \\ &\quad\left[\sqrt{I_{10}/M_{D1}} - \sqrt{I_{20}/M_{D2}}\,(1+(I_0\cdot TC\cdot\Delta T)/(2\cdot I_{20}))\right] \\ &= \sqrt{2/(C_{ox}W/L)}\cdot\mu^{-1/2}\cdot[B_1 - B_2(1+(I_0\cdot\Delta T\cdot TC)/(2\cdot I_{20}))] \\ &= \sqrt{2/(C_{ox}W/L)}\cdot\mu^{-1/2}\cdot[(B_1-B_2)-(B_2I_0/2\cdot I_{20})\cdot\Delta T\cdot TC] \end{aligned} \tag{15}$$

where $B_1=\sqrt{I_{10}/M_{D1}}$, and $B_2=\sqrt{I_{20}/M_{D2}}$.

Combining Equations (7) and (15), the offset voltage $V_{OS}$ can be represented by, $$\begin{aligned} V_{OS} &\approx \sqrt{2/(C_{ox}W/L)}\cdot\mu_0^{-1/2}\cdot[1+(\alpha/2T_0)\cdot\Delta T]\cdot \\ &\quad[(B_1-B_2)-(B_2I_0/2\cdot I_{20})\cdot\Delta T\cdot TC] \\ &= \sqrt{2/(C_{ox}W/L)}\cdot\mu_0^{-1/2}\cdot(B_1-B_2) \\ &\quad[1+(\alpha/2T_0)\cdot\Delta T]\cdot[1-(B_2I_0/2\cdot I_{20}\cdot(B_1-B_2))\cdot\Delta T\cdot TC] \end{aligned} \tag{16}$$

In order to render the offset voltage $V_{OS}$ temperature independent, the first-order ΔT dependent terms in Equation (16) need to be cancelled. In order to cancel the first-order ΔT dependent terms in Equation (16), the temperature coefficient TC can be set as, $$TC = \frac{(B_1-B_2)\cdot I_{20}}{B_2\cdot I_0}\cdot\frac{\alpha}{T_0} \tag{17}$$

As a result, the offset voltage $V_{OS}$ can be represented by, $$V_{OS}=\sqrt{2/(C_{ox}W/L)}\cdot\mu_0^{-1/2}\cdot(B_1-B_2) \tag{18}$$

Thus, in circuit 900, the reference current $I_{REF}$ can be determined according to Equations (13) and (17), and the offset voltage $V_{OS}$ can be determined according to Equation (18). As seen in Equations (13) and (17), $I_{REF}$ includes a temperature independent current $I_0$ for producing the target output current at room temperature, and a temperature dependent current $I_0 \cdot \Delta T \cdot TC$ for temperature compensation.

Similar to circuit 700 of FIG. 7, current source 910 can be implemented by a temperature independent current source and a temperature dependent current source. The temperature independent current source generates the reference current $I_0$ at room temperature $T_0$. The temperature dependent current source generates the temperature dependent current $I_0 \cdot \Delta T \cdot TC$.

Figure 10:
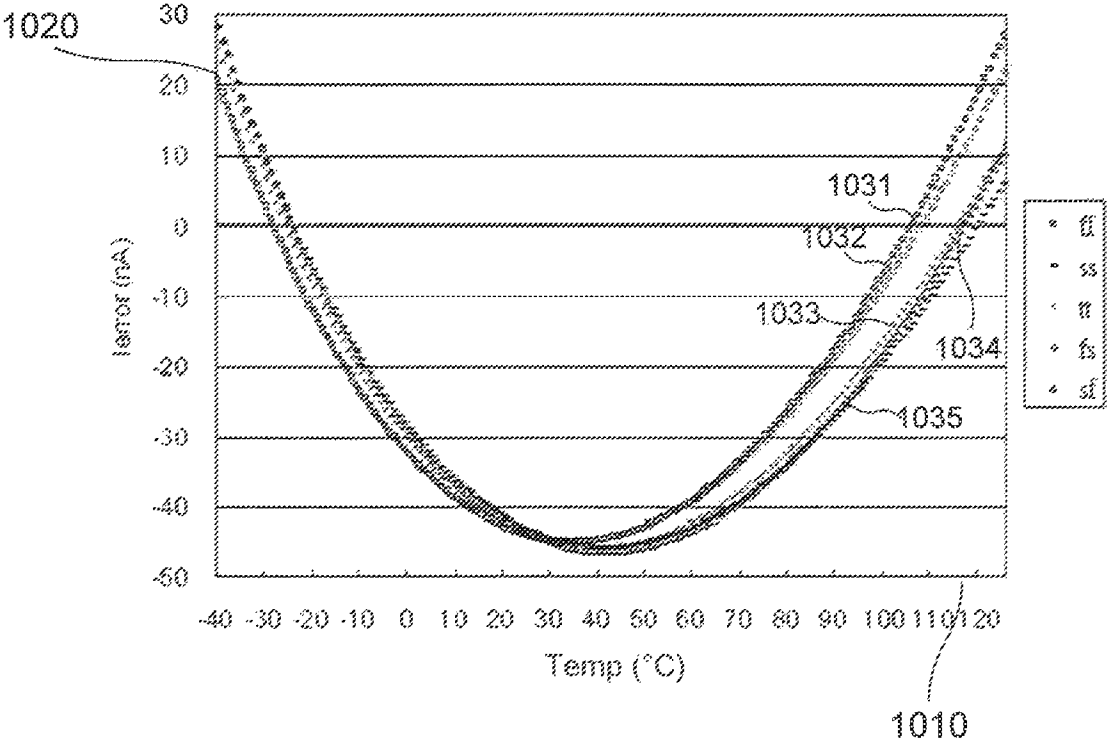
FIG. 10 is a computer simulation result of temperature compensation characteristics of the current mirror circuit of FIG. 9.

FIG. 10 is a computer simulation result of temperature compensation characteristics of circuit 900. In the graph of FIG. 10, an abscissa 1010 represents the operation temperature T (in degrees C.), and an ordinate 1020 represents an output current error between the actual output current $I_{OUT}$ (in nA) and the target output current $I_{10}$. Curve 1031 represents the temperature compensation error resulting from a simulation using the fast-fast (MOS_FF) corner model. Curve 1032 represents the temperature compensation error resulting from a simulation using the fast-slow (MOS_FS) corner model. Curve 1033 represents the temperature compensation error resulting from a simulation using the typical-typical (MOS_TT) corner model. Curve 1034 represents the temperature compensation error resulting from a simulation using the slow-fast (MOS_SF) corner model. Curve 1035 represents the temperature compensation error resulting from a simulation using the slow-slow (MOS_SS) corner model.

During the simulation to produce the results illustrated in FIG. 10, the room temp reference current $I_0$ is set to be 12.6 uA and the offset voltage $V_{OS}$ is determined based on Equation (18) to meet $I_{out}=I_{10}=10$ uA at the middle of a temperature simulation range for each process corner. Also, the temperature dependent current $I_0 \cdot \Delta T \cdot TC$ is assumed to not be adjustable. According to Equation (17), the temperature coefficient TC of $I_{REF}$ is independent of Cox and μ, but only relates to known parameters such as B1, B2, $I_0$, $I_{20}$, $T_0$ and α. That is, the temperature dependent part $I_0 \cdot \Delta T \cdot TC$ of $I_{REF}$ is less sensitive to process variations. As a result, as illustrated in FIG. 10, the temperature compensation error does not vary with different process corners as much as those in FIG. 8. Thus, circuit 900 including the temperature dependent current source 910 reduces the variation of temperature compensation error in different process corners.

Figure 11:
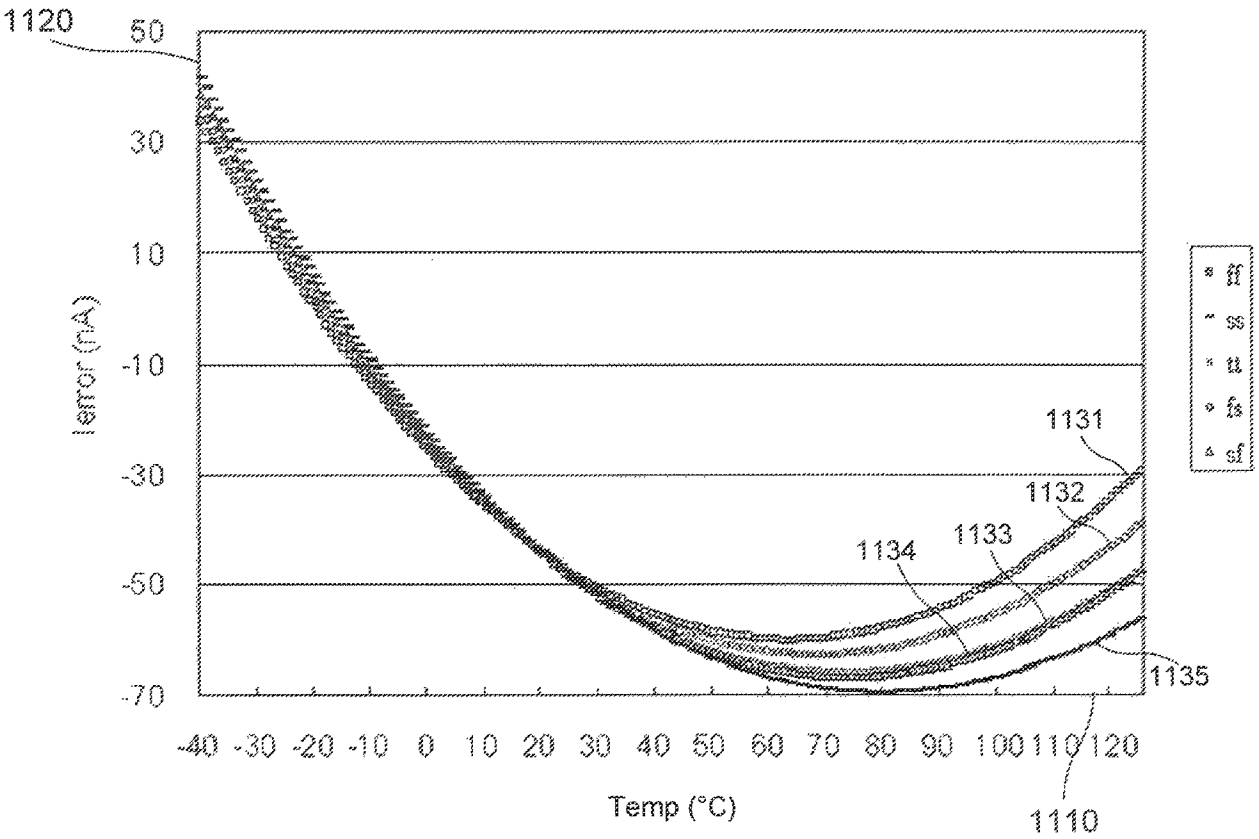
FIG. 11 is a computer simulation result of temperature compensation characteristics of the current mirror circuit of FIG. 9, when a room temperature reference current shifts.

FIG. 11 is a computer simulation result of temperature compensation characteristics of circuit 900, when the room temperature reference current $I_c$) shifts to become $I_0'=90\% \cdot I_0$. In the graph of FIG. 11, an abscissa 1110 represents the operation temperature T (in degrees C.), and an ordinate 1120 represents an output current error $I_{error}=I_{OUT}-I_{10}$ (in nA), where $I_{10}$ is 10 μA, and $I_{OUT}$ is obtained when $I_{REF}$ is determined based on Equations (13) and (17), with TC in Equation (17) being determined based on the original $I_0=12.6$ μA, and $I_0$ in Equation (13) being $I_0'=90\% \cdot I_0$. Curve 1131 represents the temperature compensation error resulting from a simulation using the fast-fast (MOS_FF) corner model. Curve 1132 represents the temperature compensation error resulting from a simulation using the fast-slow (MOS_FS) corner model. Curve 1133 represents the temperature compensation error resulting from a simulation using the typical-typical (MOS_TT) corner model. Curve 1134 represents the temperature compensation error resulting from a simulation using the slow-fast (MOS_SF) corner model. Curve 1135 represents the temperature compensation error resulting from a simulation using the slow-slow (MOS_SS) corner model.

When $I_0=12.6$ uA shifts to $I_0'=90\% \cdot I_0=11.3$ uA, $I_0'$ is larger than the target output current $I_{10}=10$ μA. Although the polarity of Vos, the values of $I_{10}$, and $B_1$ in Equations (17) and (18) are all unchanged, the value of $I_{20}$ now shifts from $I_{20}=I_0-I_{10}=2.6$ uA to $I_{20}'=I_0'-I_{10}=1.3$ uA, which makes $B_2'$ ($=\sqrt{I_{20}'/M_{D2}}$) smaller. Considering the deviation of $I_{20}'$ and $B_2'$ in Equations (17) and (18), both the ideal $$TC'\left(=\frac{(B_1-B_2')\cdot I_{20}'}{B_2'\cdot I_0'}\cdot\frac{\alpha}{T_0}\right)$$

and Vos' ($=\sqrt{2/(C_{ox}W/L)}\cdot\mu_0^{-1/2}\cdot(B_1-B_2')$) for $I_0'$ should be higher than original TC and Vos for $I_0$. This explains the negative trend of Ierror in FIG. 11 when temperature changes from −40° C. to 40° C. Finally, the differences between the values of Ierror across the five corners increase when the temperature increases to 125° C.

Figure 12:
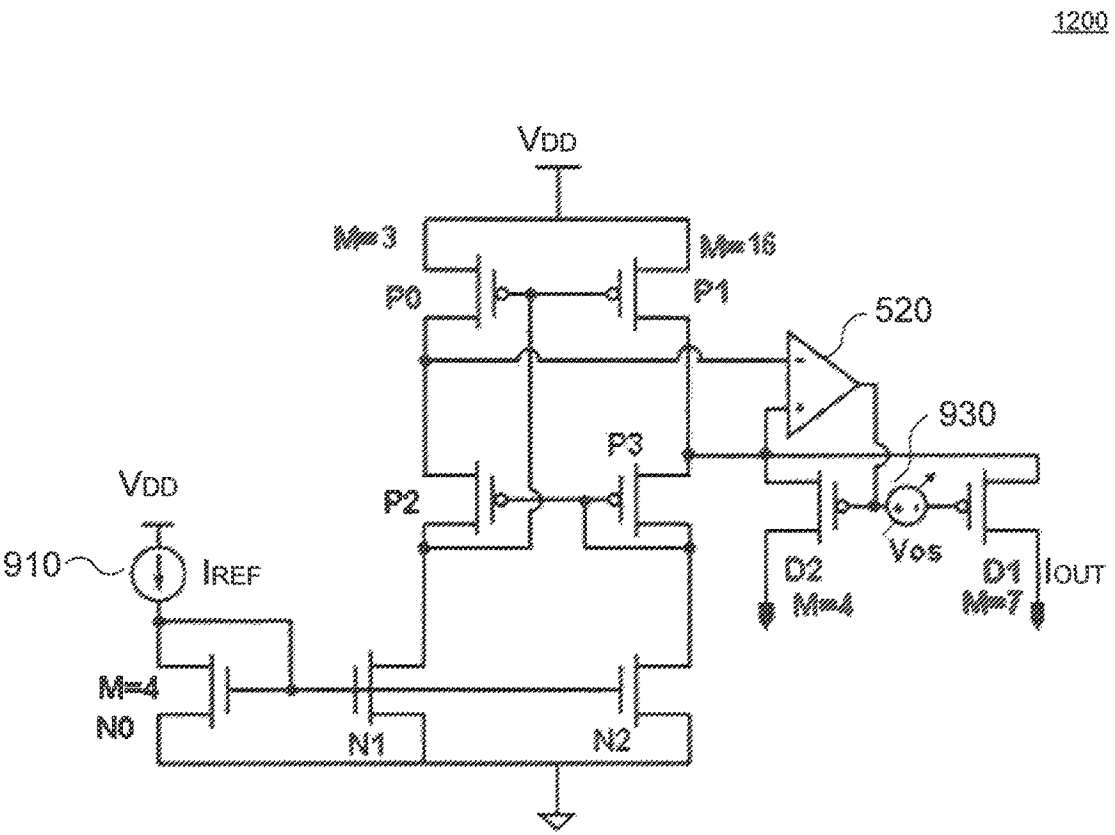
FIG. 12 schematically illustrates a circuit diagram of a current mirror circuit according to an illustrated embodiment.

FIG. 12 schematically illustrates a circuit diagram of a current mirror circuit 1200 (hereinafter referred to as "circuit 1200"), according to an illustrated embodiment. Circuit 1200 includes PMOS transistors P0 and P1 with adjusted M factors for compensating for a shifting of $I_0$.

Referring to FIG. 12, circuit 1200 includes current source 910, NMOS transistors N0 to N2, PMOS transistors P0 to P3, D1 and D2, operational amplifier 520, and voltage source 930, that are similar to the components of circuit 900. Unlike circuit 900, the M factor $M_{p0}$ of PMOS transistor P0 is 3, and the M factor $M_{P1}$ of PMOS transistor P1 is 16.

Circuit 1200 is applied in a situation when the room temperature reference current $I_0$ shifts to become $I_0'=90\% \cdot I_0$. As explained previously, when $I_0$ shifts to become $I_0'=90\% \cdot I_0$, the temperature dependent part of Iref also shifts by a 90% factor. This results in temperature compensation error across different process corners, especially at high temperature region. However, in circuit 1200, the ratio of $M_{P1}/M_{P0}$ is adjusted to become 16/3 instead of 5/1 so that the shifted current $I_0'$ is enlarged 1.083 (=(16/3−1)/4) times. As a result, 1.083 $I_0'$ is equivalent to 97.49% (=1.083×0.9) of original $I_0$.

In circuit 1200, the M factors of PMOS transistors P0 and P1 are 3 and 16, respectively. However, the present disclosure is not limited thereto, and the M factors of PMOS transistors P0 and P1 are determined based on the shifting of the room temperature reference current $I_0$. For example, in order to adjust the M factors of PMOS transistors P0 and P1, circuit 1200 can include a MOS switch (not shown) connected to each one of PMOS transistors P0 and P1. When shifting of $I_0$ is detected, the MOS switches can adjust the M factors of PMOS transistors P0 and P1 based on the shifting of $I_0$.

Figure 13:
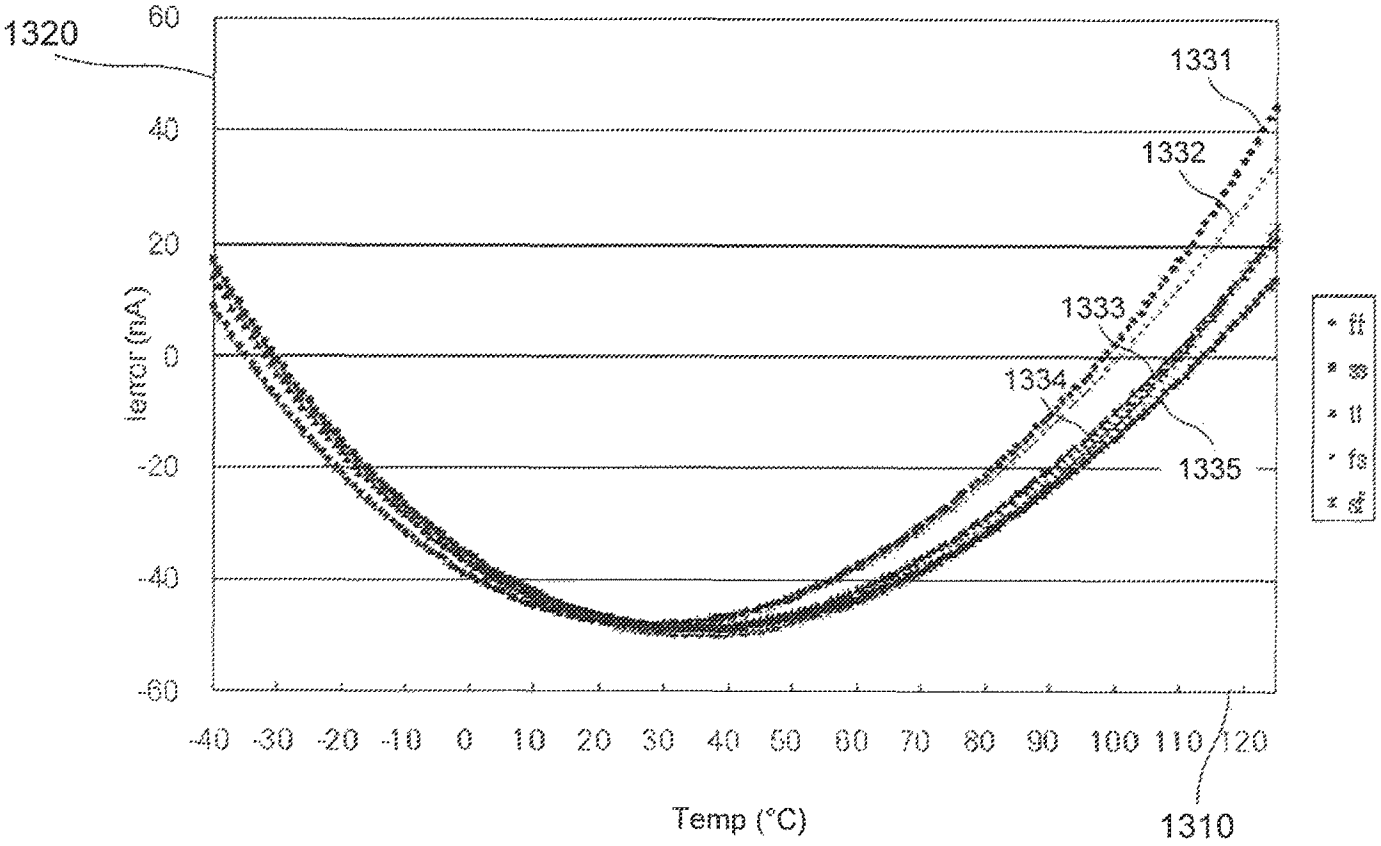
FIG. 13 is a computer simulation result of temperature compensation characteristics of the current mirror circuit of FIG. 12, when a room temperature reference current shifts.

FIG. 13 is a computer simulation result of temperature compensation characteristics of circuit 1200, when the room temperature reference current $I_0$ shifts to become $I_0'=90\% \cdot I_0$. In the graph of FIG. 13, an abscissa 1310 represents the operation temperature T (in degrees C.), and an ordinate 1320 represents an output current error $I_{error}=I_{OUT}-I_{10}$ (in nA), where $I_{10}$ is 10 μA, and $I_{OUT}$ is obtained when $I_{REF}$ is determined based on Equations (13) and (17), with TC in Equation (17) being determined based on the original $I_0=12.6$ μA, and $I_0$ in Equation (13) being $I_0'=90\% \cdot I_0$. Curve 1331 represents the temperature compensation error resulting from a simulation using the fast-fast (MOS_FF) corner model. Curve 1332 represents the temperature compensation error resulting from a simulation using the fast-slow (MOS_FS) corner model. Curve 1333 represents the temperature compensation error resulting from a simulation using the typical-typical (MOS_TT) corner model. Curve 1334 represents the temperature compensation error resulting from a simulation using the slow-fast (MOS_SF) corner model. Curve 1335 represents the temperature compensation error resulting from a simulation using the slow-slow (MOS_SS) corner model.

As explained previously, in circuit 1200, because the M factors of PMOS transistors P0 and P1 are adjusted to enlarge the shifted $I_0'$, the output current $I_{OUT}$ remains at $I_{10}$ even when $I_0$ shifts. As a result, curves 1331 to 1335 in FIG. 13 are similar to curves 1031 to 1035 in FIG. 10. That is, the values of Ierror at −40° C. and at 125° C. across five corners are closer to each other in FIG. 13 compared with those in FIG. 11. For example, the maximum difference between Ierror at −40° C. and at 125° C. is reduced from 97.82 nA in FIG. 11 to 36.22 nA in FIG. 13.

Figure 14:
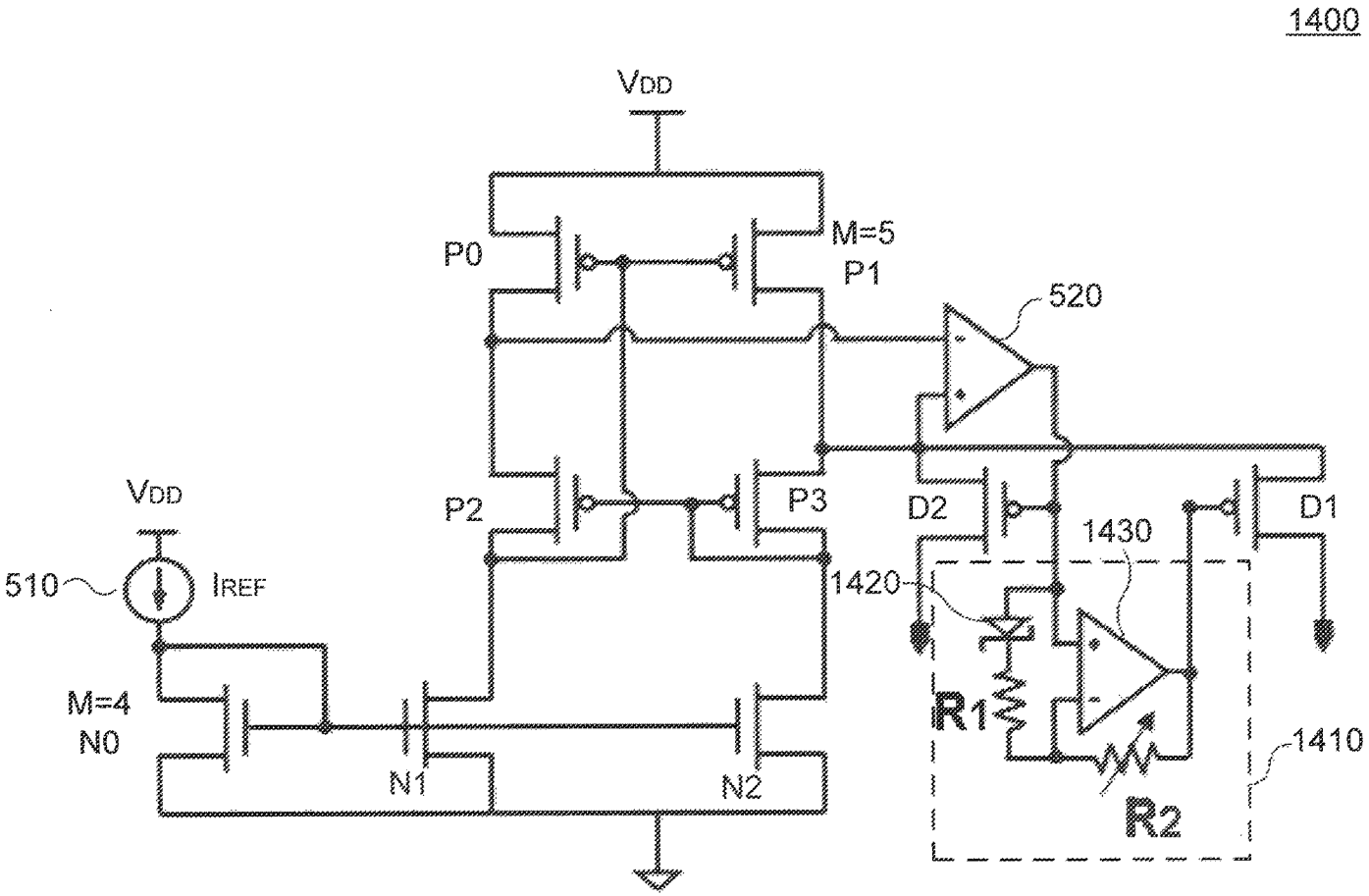
FIG. 14 schematically illustrates a circuit diagram of a current mirror circuit according to an illustrated embodiment.

FIG. 14 schematically illustrates a circuit diagram of a current mirror circuit 1400 (hereinafter referred to as "circuit 1400"), according to an illustrated embodiment. Circuit 1400 includes a voltage scaling circuit as an implementation of adjustable voltage source 530 of circuit 500.

Referring to FIG. 14, circuit 1400 includes current source 510, NMOS transistors N0 to N2, PMOS transistors P0 to P3, D1, and D2, operational amplifier 520, and a voltage scaling circuit 1410. Current source 510, NMOS transistors N0 to N2, PMOS transistors P0 to P3, D1, and D2, operational amplifier 520 are similar to the similar components of circuit 500 of FIG. 5.

Voltage scaling circuit 1410 is connected between the gate terminal of PMOS transistor D2 and the gate terminal of PMOS transistor D1. Voltage scaling circuit 1410 includes a Zener diode 1420, a first resistor R1, a second resistor R2, and an operational amplifier 1430. Zener diode 1420 includes a first terminal coupled to the gate terminal of PMOS transistor D2, and a second terminal coupled to first resistor R1. First resistor R1 includes a first terminal coupled to the second terminal of Zener diode 1420 and a second terminal coupled to second resistor R2. Second resistor R2 is an adjustable resistor, and includes a first terminal coupled to first resistor R1 and a second terminal coupled to the gate terminal of PMOS transistor D1. Operational amplifier 1430 includes a non-inverting terminal (denoted as "+") coupled to the gate terminal of PMOS transistor D2, an inverting terminal (denoted as "−") coupled to the second terminal of first resistor R1, and an output terminal coupled to the gate terminal of PMOS transistor D1.

Voltage scaling circuit 1410 functions as an adjustable voltage source that generates an offset voltage $V_{OS}$ applied between the gate terminals of PMOS transistors D1 and D2. The offset voltage $V_{OS}$ can be represented by, $$V_{OS} = -\frac{R_2}{R_1} V_z$$

where $R_1$ is the resistance of first resistor R1, $R_2$ is the resistance of second resistor R2, and $V_Z$ is the breakdown voltage of Zener diode 1420. Because second resistor R2 is an adjustable resistor, $V_{OS}$ is adjustable by adjusting the resistance of second resistor R2. For example, $V_{OS}$ can be adjusted according to Equation (5), such that the output current $I_{OUT}$ of circuit 1400 can be a target value $I_{target}$.

Circuits 300, 500, 700, 900, 1200, and 1400 are MOS circuits. However, the present disclosure is not limited to MOS circuits and can be applied to field effect transistor (FET) circuits, bipolar junction transistor (BJT) circuits, and bipolar junction transistor and complementary metal-oxide-semiconductor (BiCMOS) circuits.

The current mirrors of the embodiments of the present disclosure can be applied to a circuit system where a precise source current is desired, such as relaxation oscillator circuits and current comparators, etc.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A current mirror circuit, comprising:

a current source for generating a reference current;

a mirror circuit coupled to the current source and having a first node for passing a first mirroring current and a second node for passing a second mirroring current;

a feedback circuit coupled to the mirror circuit for equalizing voltages on the first and second nodes; and a tunable element including a first output transistor and a second output transistor coupled to the mirror circuit and driven by an output of the feedback circuit for providing a target output current, wherein a first gate voltage and a second gate voltage different from the first gate voltage are supplied to respective gate terminals of the first output transistor and the second output transistor.

2. The current mirror circuit of claim 1, wherein:

the first output transistor coupled to the second node for outputting the target output current; and the second output transistor coupled to the second node and driven by an output of an operational amplifier;

the tunable element further including an adjustable voltage source coupled between the gate terminals of the first and second output transistors for generating an offset voltage to provide the target output current, the offset voltage being a difference between the first gate voltage and the second gate voltage.

3. The current mirror circuit of claim 2, wherein the adjustable voltage source generates the offset voltage based on a charge-carrier mobility, a gate oxide capacitance per unit area, a width-to-length ratio of the first and second output transistors, the target output current, the reference current, and M factors of the first and second output transistors.

4. The current mirror circuit of claim 2, wherein a polarity of the adjustable voltage source is configured based on the target output current, the reference current, and M factors of the first and second output transistors.

5. The current mirror circuit of claim 2, wherein the adjustable voltage source generates a room temperature offset voltage providing the target output current at room temperature, and a temperature dependent offset voltage to compensate for a variation of the output current due to a temperature variation.

6. The current mirror circuit of claim 5, wherein the adjustable voltage source generates the room temperature offset voltage based on a gate oxide capacitance per unit area, a width-to-length ratio of the first and second output transistors, a room temperature charge-carrier mobility, the target output current, the reference current, and M factors of the first and second output transistors, at least one of the gate oxide capacitance per unit area and the room temperature charge-carrier mobility varying across process corners, and the adjustable voltage source generates the temperature dependent offset voltage based on the room temperature offset voltage, a difference between an operation temperature and a room temperature, and a temperature coefficient which is determined based on a temperature exponent of a charge-carrier mobility and the room temperature.

7. The current mirror circuit of claim 2, wherein the adjustable voltage source generates the offset voltage which is temperature independent, and the current source generates the reference current which is temperature dependent to compensate for a variation of the output current due to a temperature variation.

8. The current mirror circuit of claim 7, wherein the current source generates a room temperature reference current and a temperature dependent reference current, the current source generating the temperature dependent reference current based on the room temperature reference current, a difference between an operation temperature and a room temperature, and a temperature coefficient, and the temperature coefficient being related to a temperature code of a charge-carrier mobility, the room temperature, the reference current, the target output current, the charge-carrier mobility, a gate oxide capacitance per unit area, and M factors of the first and second output transistors.

9. The current mirror circuit of claim 2, wherein the adjustable voltage source is implemented by a voltage scaling circuit.

10. The current mirror circuit of claim 1, wherein the mirror circuit includes a first mirroring transistor coupled to the first node and a second mirroring transistor coupled to the second node, M factors of the first and second mirroring transistors being configured to compensate for a variation of the reference current at room temperature.

11. A method for generating a target output current by a current mirror, comprising:

providing a current mirror including:

a current source for generating a reference current;

a mirror circuit coupled to the current source having a first node for passing a first mirroring current and a second node for passing a second mirroring current;

a feedback circuit coupled to the mirror circuit for equalizing voltages on the first and second nodes; and a tunable element including a first output transistor and a second output transistor coupled to the mirror circuit and driven by an output of the feedback circuit for providing the target output current; and supplying a first gate voltage and a second gate voltage to respective gate terminals of the first output transistor and the second output transistor of the tunable element.

12. The method of claim 11, wherein the providing the current mirror including the tunable element further includes:

providing the first output transistor coupled to the second node for outputting a target output current;

providing the second output transistor coupled to the second node and driven by an output of an operational amplifier; and providing an adjustable voltage source coupled between the gate terminals of the first and second output transistors for generating an offset voltage, the offset voltage being a difference between the first gate voltage and the second gate voltage.

13. The method of claim 12, further including determining the offset voltage based on a charge-carrier mobility, a gate oxide capacitance per unit area, a width-to-length ratio of the first and second output transistors, the target output current, the reference current, and M factors of the first and second output transistors.

14. The method of claim 12, further including configuring a polarity of the adjustable voltage source based on the target output current, the reference current, and M factors of the first and second output transistors.

15. The method of claim 12, further including adjusting the offset voltage to compensate for a variation of the output current due to a temperature variation.

16. The method of claim 15, wherein the adjusting the offset voltage further includes:

adjusting a room temperature offset voltage for providing the target output current at a room temperature; and adjusting a temperature dependent offset voltage to compensate for a variation of the output current due to the temperature variation.

17. The method of claim 11, further including adjusting the reference current generated by the current source to compensate for a variation of the output current due to a temperature variation.

18. The method of claim 17, wherein the reference current includes a room temperature reference current and a temperature dependent reference current, the adjusting the reference current including adjusting the temperature dependent reference current based on the room temperature reference current, a difference between an operation temperature and a room temperature, and a temperature coefficient.

19. The method of claim 11, wherein the providing the mirror circuit includes:

providing a first mirroring transistor coupled to the first node;

providing a second mirroring transistor coupled to the second node; and adjusting M factors of the first and second mirroring transistors to compensate for a variation of the reference current at room temperature.

* * * * *